US005579701A

United States Patent [19]

Fook Wah

[11] Patent Number: 5,579,701

[45] Date of Patent: Dec. 3, 1996

[54] COMPLETELY KNOCK DOWN PLASTIC PALLET AND METHOD OF MANUFACTURING THE SAME

[76] Inventor: Charles H. Fook Wah, No. 3, Jln 2/149H, Tmn Sri Endah, Sri Petaling, 57000 Kuala Lumpur, Malaysia

[21] Appl. No.: 294,665

[22] Filed: Aug. 23, 1994

[30] Foreign Application Priority Data

Aug. 23, 1993 [MY] Malaysia ..... PI9301687

[51] Int. Cl.[6] ..... B65D 19/12

[52] U.S. Cl. ..... 108/56.1; 108/902

[58] Field of Search ..... 108/901, 902, 108/56.1, 56.3, 51.1

[56] References Cited

U.S. PATENT DOCUMENTS

| | | | |
|---|---|---|---|
| 2,904,297 | 9/1959 | Hamilton | 108/56.3 X |
| 3,149,586 | 9/1964 | Kemp, Jr. et al. | 108/56.1 X |
| 3,878,796 | 4/1975 | Morrison | 108/901 X |
| 4,869,179 | 9/1989 | Sammons et al. | 108/56.1 |
| 5,333,555 | 8/1994 | McPhee | 108/56.1 X |
| 5,365,859 | 11/1994 | Schrage | 108/901 X |
| 5,417,167 | 5/1995 | Sadr | 108/901 X |
| 5,440,998 | 8/1995 | Morgan, IV et al. | 108/901 X |

*Primary Examiner*—Jose V. Chen
*Attorney, Agent, or Firm*—Knobbe, Martens, Oslon & Bear

[57] ABSTRACT

A completely knock down plastic pallet comprising a set of runners, a set of top deck elements, and a set of bottom deck elements. The runners comprising two end runners which define opposed side faces of the pallet and one or more intermediate runners located at spaced intervals between the end runners. The top deck elements being received in the top face of the intermediate runners. The ends of the top deck elements are engaged in cavities formed in the end runners. The bottom deck elements are received on the bottom face of the intermediate runners and the ends of the bottom deck elements being engaged in a set of further cavities formed in the end runners.

24 Claims, 5 Drawing Sheets

COMPLETELY KNOCK DOWN PLASTIC PALLET AND METHOD OF MANUFACTURING THE SAME

TECHNICAL FIELD

The present invention relates to plastic pallets which are intended for supporting goods during shipment, storage and transportation.

PRIOR ART

There are many types of plastic pallets which are widely being used throughout the world to facilitate shipment and transportation of goods. The purpose of the pallet is to provide a support for the cargo particularly during shipment and storage and there has been an increasing requirement for such pallets to become more sophisticated due to varying standards and demands.

Conventionally pallets have been formed of timber however these pallets have suffered several disadvantages due to the nature of the material of which they are formed. Such pallets are naturally heavy, bulky and expensive because of the nature of the material used in their construction. In addition, wooden pallets suffer deterioration due to inclement weather conditions and can suffer damages as a result of water which may be present in the location in which they are being used. The presence of such water results in the rotting of the timber and resultant weakening of the structure of the pallet. Furthermore such pallets are generally held together by means of gluing using suitable adhesives and/or nails or staples which are formed of metal. These methods of fixing of the components of the pallets together can also suffer as a result of the inclement conditions the pallet is required to undergo as a result of deterioration of the adhesive and/or corrosion of the nails or staples. Furthermore such pallets can be the subject of insect infestation which can result in the deterioration of the pallet but also can result in the introduction of undesirable infestations of insects from one location to another.

As a result of each of the above difficulties wooden pallets are required to be the subject of regular maintenance and the replacement of broken or damaged components in order to maintain the integrity of the pallets. This requirement for regular maintenance and replacement increases the costs of utilisation of the pallets.

Furthermore the damage which can be inflicted upon the wooden pallets can result in damage to the goods being transported or stored upon the pallets.

With improved quality control the difficulties created by utilisation of wooden pallets have rendered such pallets as being generally undesirable and has resulted in the need for pallets of a higher standard.

Plastic pallets have been proposed as an alternative to wooden pallets however such plastic pallets are generally formed as an integral structure which requires specialised manufacturing equipment or techniques.

SUMMARY OF THE INVENTION

The present invention relates to a plastic pallet of the form of a completely knock down plastic pallet and the method of manufacturing it for dynamic cargo shipment and storage. Generally the pallets are designed and configured for fork-lifts, stackers, hand pallet trucks etc. to facilitate the easy storage or transportation from one place to another. The pallets according to the invention provide several advantages in regard to their construction and usage whenever goods are to be transported in comparison to wooden pallets. In addition being formed of plastic they can be used in static platforms to support and store goods under both warehouse conditions and open conditions.

An object of the present invention is to provide an easily assembled pallet that is capable of retaining its shape, rigidity and strength throughout its life in a better manner than has been possible in relation to conventional wooden pallets.

In one form the invention resides a completely knock down plastic pallet comprising a set of runners, a set of top deck elements, and a set of bottom deck elements, said runners comprising two end runners which define opposed side faces of the pallet and one or more intermediate runners located at spaced intervals between the end runners, said top deck elements being received in the top face of the intermediate runners, the ends of the top deck elements being engaged in cavities formed in the end runners, the bottom deck elements being received on the bottom face of the intermediate runners and the ends of the bottom deck elements being engaged in a set of further cavities formed in the end runners.

In a preferred form the plastic pallet is of a rectangular configuration and is dimensioned according to the users requirements.

The pallet is formed from a suitable plastics material and as a result it is significantly lighter than conventional wooden pallets. An advantage presented by utilisation of plastics material is that the pallet has a longer life and is lighter. In addition the surface of the pallet can be formed of a variety of profiles and configurations for visual attractiveness.

The plastic pallet according to the invention offers a solution to plastic pallets which have previously been in use as a result of the reduced production costs by avoiding a one piece moulded construction which has been the usual method of constructing conventional plastic pallets. This object is achieved by forming the pallet from a plurality of components which can be formed separately and as a result can be formed from injection moulding machines of smaller capacity which can occupy less space than injection machines required to form conventional plastic pallets.

In addition, the assembly of the pallets utilising the components can be simplified since there are only three sets of components which comprise the top deck elements, the bottom deck elements and the runners. In a preferred form of the invention the components are formed to be interengagable with each other to contribute to the structural integrity of the pallet.

DESCRIPTION OF THE EMBODIMENTS

The exact nature of the present invention will become more clearly apparent upon reference to the following description of several specific embodiments of the invention. The description is made with reference to the accompanying drawings of which:

It has been found that the completely knock down plastic pallets of the embodiments can be formed by way of injection moulding techniques which are utilised to form each of the components of the pallets. Pallets according to the embodiments can be used for the transportation and storage of goods under the conditions which are normally required of such pallets with a reduced likelihood of deterioration or infestation.

Figure 1:
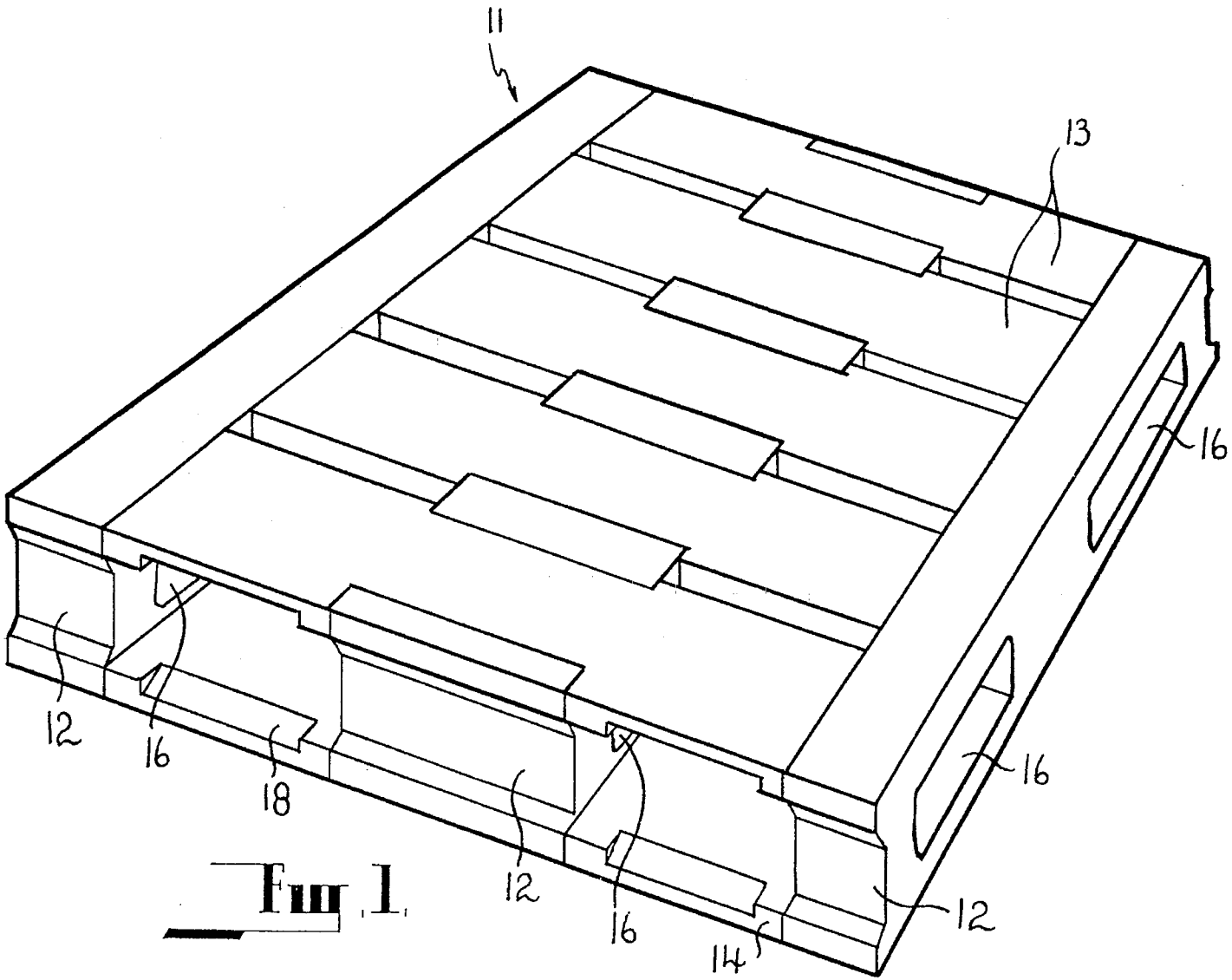
FIG. 1 is a perspective view of the first embodiment.
Figure 2:
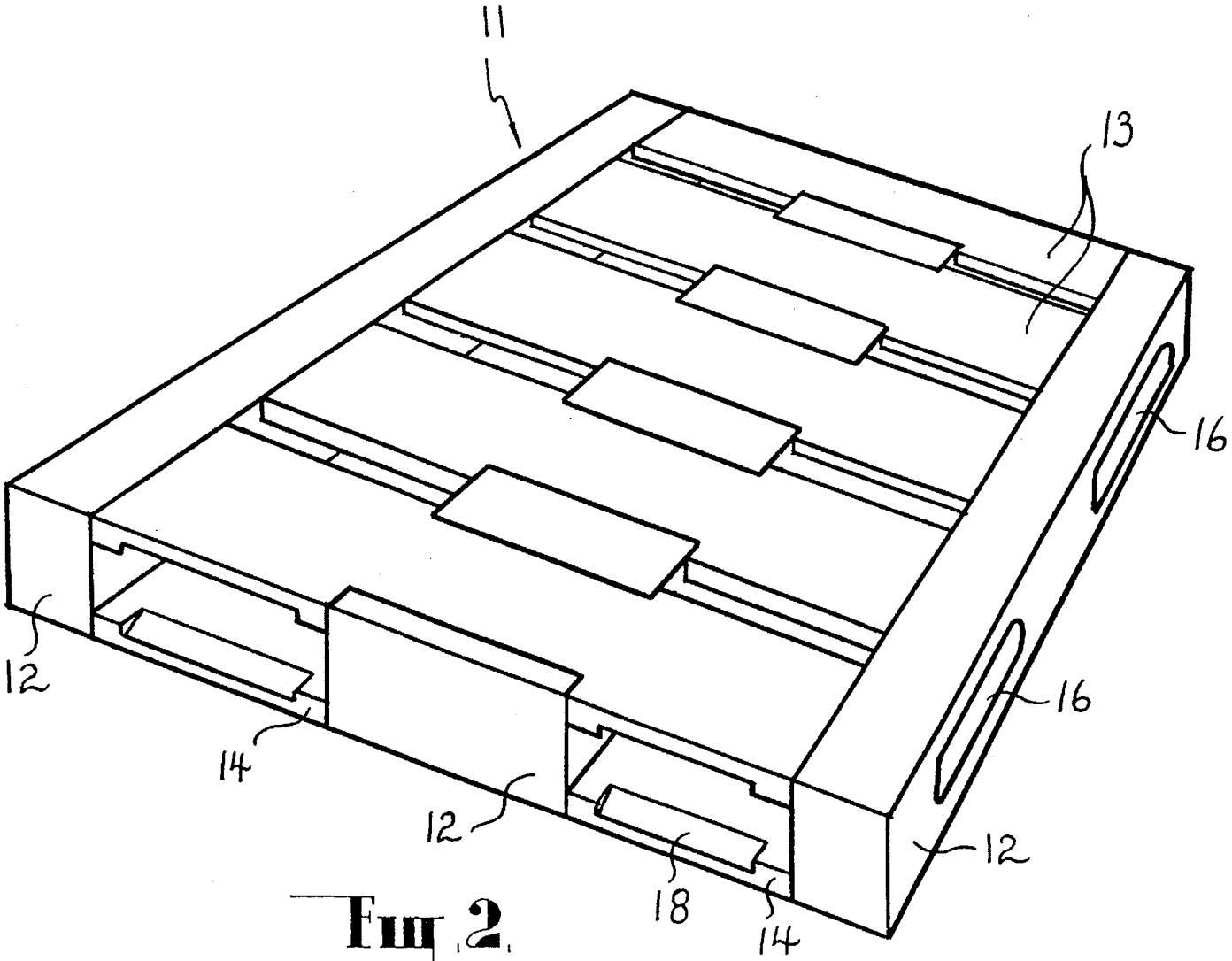
FIG. 2 is a perspective view of the second embodiment of the invention.
Figure 3:
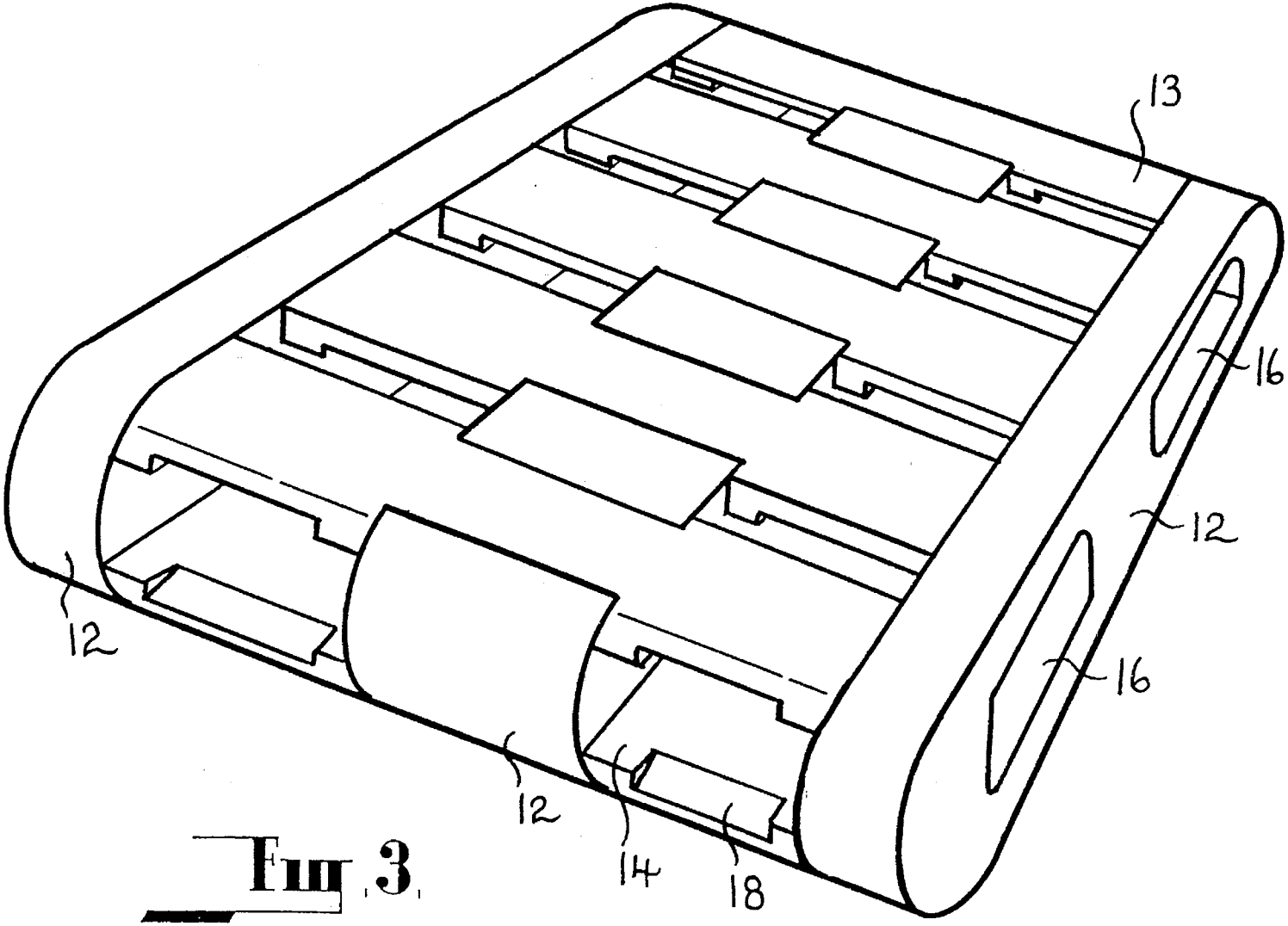
FIG. 3 is a perspective view of a third embodiment of the invention.
Figure 4:
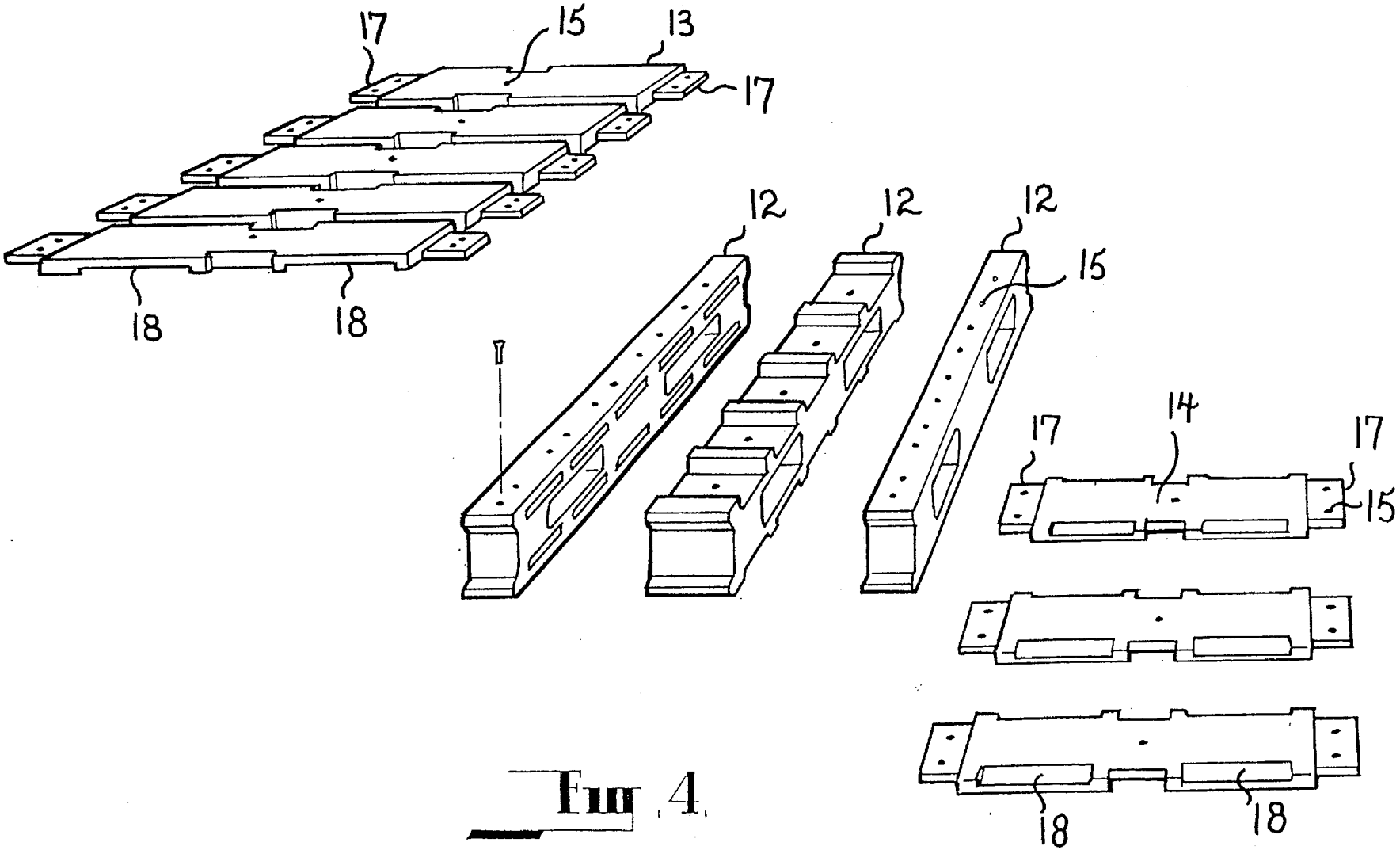
FIG. 4 is an exploded view of the first embodiment.
Figure 7:
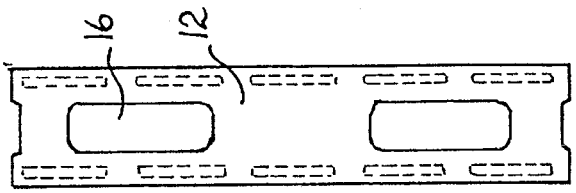
FIG. 7 is an end elevation of the first embodiment.
Figure 6:
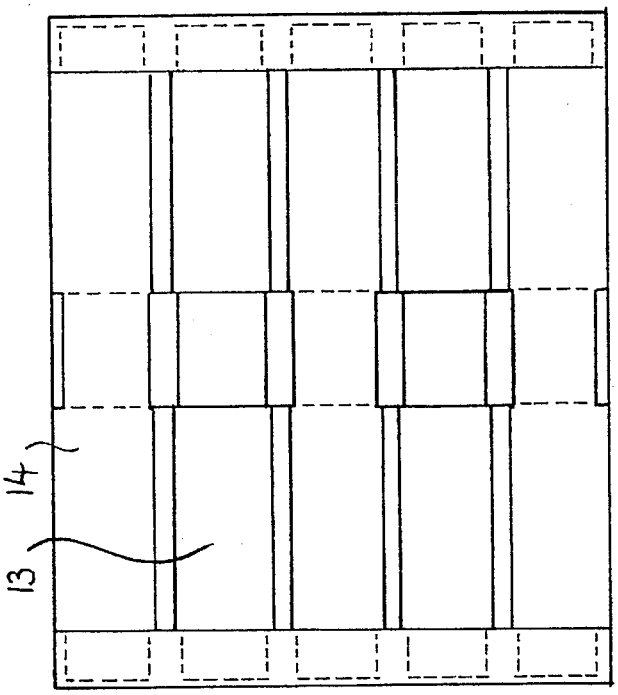
FIG. 6 is an inverted plan view of the first embodiment.
Figure 8:
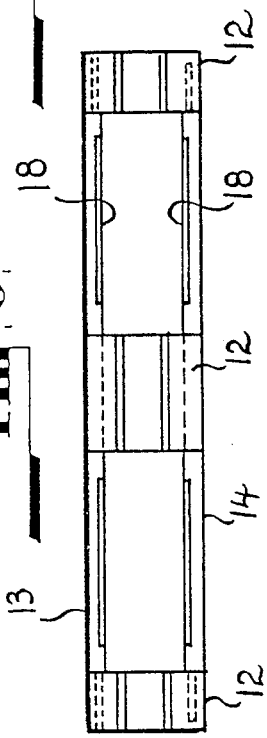
FIG. 8 is a side elevation of the first embodiment.
Figure 5:
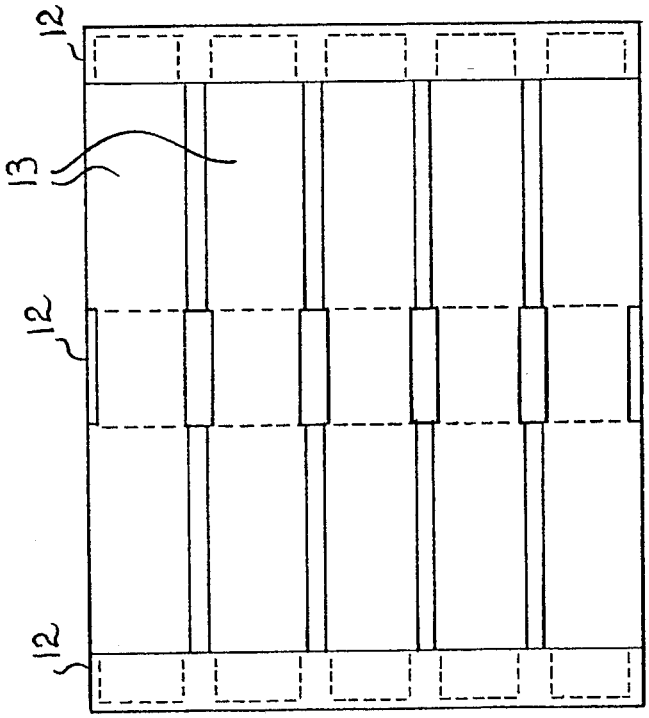
FIG. 5 is a plan view of the first embodiment.

The pallets of the various embodiments shown at FIGS. 1, 2 and 3 comprise a completely knock down plastic pallet 11 which each comprise a set of three runners 12, a set of five top deck elements 13 and a set of three bottom deck elements 14. The runners 12 of each of the embodiments are each formed with a set of forklift holes 16 which are located at spaced intervals along the length of the runners and which facilitate the easy entry of the lifting forks of the forklift truck or the like. The holes 16 in each of the runners are aligned in the assembled pallet to facilitate the passage of the lifting forks through the pallet between the top and bottom decks.

Each end of each top deck element 13 and each end of each bottom deck element 14 is formed with a tenon 17 which are each receivable in a correspondingly shaped cavity 19 formed in a side face of the end most runners 12. The cavities are located such that when the tenons 17 are fully received in the cavities the adjacent top or bottom surfaces of the end most runners 12 and the respective top and bottom surface of the top and bottom deck elements 13 are substantially coplanar.

The top and bottom surface of the central runner is designed and configured with a set of recesses 10 which are shaped to receive the respective deck elements 13 and 14 to support the deck elements and provide a top and bottom surface respectively which are substantially coplanar. A plurality of preformed screw holes 15 are formed in the top and bottom deck elements 13, 14 and the runners 12 where the deck elements engage with the runners and whereby the holes in the abutting portions of the deck elements and runners are aligned to enable the insertion of screws to facilitate easy assembly.

In assembling a pallet the tenons 17 of the top and bottom deck elements 13 and 14 are received in the respective cavities in the end most runners and in the respective recesses 10 in the central runner. Screws are then inserted in the preformed holes to secure the deck elements and runners together.

The portion of the top and bottom deck elements 13 and 14 which are received in the recesses 10 formed in the top and bottom surfaces respectively of the central runner are formed of a reduced width such that on the deck element being engaged with the central runner it is prevented from longitudinal movement with respect to the central runner. The outermost side edge of the outermost deck elements 13 and 14 is substantially colinear with the ends of the runners 12.

In addition the inner face of both the top and bottom deck elements are formed with chamfered edges 18 between the runners.

Plastic pallets of each of the embodiments can be designed to accommodate for the particular loading requirement required of the pallet and can be formed of a material to be able to withstand environmental conditions which are likely to be inflicted upon the pallet according to the nature of the goods with which they are to be used.

It is a feature of each of the embodiments that the three components of the pallet, namely the top deck elements 13, the bottom deck elements 14 and the runners 12 can be produced by small or medium sized injection moulding machines.

The pallet of each of the embodiments can be transported and stored in a disassembled form, assembled when required for use and then, if desired, disassembled to be returned to the source of the goods in order to be used again. The nature of the construction of the pallet facilitates their ready assembly and disassembly and transportation of the disassembled pallet when not in use represents a significant saving of space.

It should be appreciated that the scope of the present invention need not be limited to the particular scope of the embodiments described above.

I claim:

1. A completely knock down plastic pallet comprising a set of runners, a set of top deck elements, and a set of bottom deck elements, said runners comprising two end runners which define opposed side faces of the pallet and at least one intermediate runner located at a spaced interval between the end runners, said top deck elements being received in the top face of the intermediate runner, the ends of the top deck elements being interengaged with the end runners, the interengaging portions of said end runners and said top deck elements being configured to prevent relative movement therebetween in at least one sense in each of three mutually perpendicular directions, the bottom deck elements being interengaged with the bottom face of the intermediate runner, the interengaging portions of the bottom deck elements and the bottom face of the intermediate runner being configured to prevent relative movement therebetween in at least one sense in each of three mutually perpendicular directions, and the ends of the bottom deck elements being interengaged with the end runners, the interengaging portions of said end runners and said bottom deck elements being configured to prevent relative movement therebetween in at least one sense in each of three mutually perpendicular directions.

2. A pallet as claimed at claim 1 wherein the ends of the top and bottom deck elements are formed with tenons received in cavities in the end runners to form the interengaging portions and where the top surfaces of the end runners and the top deck elements are substantially coplanar and the bottom surfaces of the end runners and the bottom deck elements are substantially coplanar.

3. A plastic pallet as claimed at claim 2 wherein the top face of the intermediate runner is formed with a set of spaced recesses of complementary configuration to the cross-sectional configuration of the top deck elements in the region of the intermediate runner to form the interengaging portions, said recesses being positioned to receive the top deck elements such that the top surface of the intermediate runners and the top deck elements are substantially coplanar.

4. A plastic pallet as claimed at claim 3 wherein the bottom surface of the intermediate runner is formed with a set of spaced recesses of complementary configuration to the cross-sectional configuration of the bottom deck elements in the region of the intermediate runner to form the interengaging portions, said recesses being positioned to receive the bottom deck elements such that the bottom surface of the intermediate runners and the bottom deck elements are substantially coplanar.

5. A plastic pallet as claimed at claim 4 wherein the portion of the top and bottom deck elements received on the intermediate runner are formed of a reduced width.

6. A plastic pallet as claimed at claim 5 wherein the inner face of the top and bottom deck elements are each formed with a chamfered edge in the region between the runners.

7. A plastic pallet as claimed at claim 6 wherein the runners are formed with a plurality of apertures spaced along their length, said apertures being shaped to receive the lifting forks of a lifting means.

8. A plastic pallet as claimed at claim 7 wherein the top deck elements, the bottom deck elements and the runners are formed with the preformed holes, said preformed holes being located in the regions where the deck elements overlap with the runner elements and the holes in said deck elements being aligned with holes in the runner elements when the deck elements and runners are located in position.

9. A plastic pallet as claimed at claim 1 wherein the top face of the intermediate runner is formed with a set of spaced recesses of complementary configuration to the cross-sectional configuration of the top deck elements in the region of the intermediate runner to form the interengaging position, said recesses being positioned to receive the top deck elements such that the top surface of the intermediate runners and the top deck elements are substantially coplanar.

10. A plastic pallet as claimed at claim 9 wherein the bottom surface of the intermediate runner is formed with a set of spaced recesses of complementary configuration to the cross-sectional configuration of the bottom deck elements in the region of the intermediate runner to form the interengaging portions, said recesses being positioned to receive the bottom deck elements such that the bottom surface of the intermediate runners and the bottom deck elements are substantially coplanar.

11. A plastic pallet as claimed at claim 10 wherein the portion of the top and bottom deck elements received on the intermediate runner are formed of a reduced width.

12. A plastic pallet as claimed at claim 11 wherein the runners are formed with a plurality of apertures spaced along their length, said apertures being shaped to receive the lifting forks of a lifting means.

13. A plastic pallet as claimed at claim 12 wherein the top deck elements, the bottom deck elements and the runners are formed with the preformed holes, said preformed holes being located in the regions where the deck elements overlap with the runner elements and the holes in said deck elements being aligned with holes in the runner elements when the deck elements and runners are located in position.

14. A plastic pallet as claimed at claim 1 wherein the bottom surface of the intermediate runner is formed with a set of spaced recesses of complementary configuration to the cross-sectional configuration of the bottom deck elements in the region of the intermediate runner to form the interengaging positions, said recesses being positioned to receive the bottom deck elements such that the bottom surface of the intermediate runners and the bottom deck elements are substantially coplanar.

15. A plastic pallet as claimed at claim 14 wherein the portion of the top and bottom deck elements received on the intermediate runner are formed of a reduced width.

16. A plastic pallet as claimed at claim 15 wherein the inner face of the top and bottom deck elements are each formed with a chamfered edge in the region between the runners.

17. A plastic pallet as claimed at claim 16 wherein the runners are formed with a plurality of apertures spaced along their length, said apertures being shaped to receive the lifting forks of a lifting means.

18. A plastic pallet as claimed at claim 1 wherein the inner face of the top and bottom deck elements are each formed with a chamfered edge in the region between the runners.

19. A plastic pallet as claimed at claim 1 wherein the runners are formed with a plurality of apertures spaced along their length, said apertures being shaped to receive the lifting forks of a lifting means.

20. A plastic pallet as claimed at claim 1 wherein the top deck elements, the bottom deck elements and the runners are formed with preformed holes, said preformed holes being located in the regions where the deck elements overlap with the runner elements and the holes in said deck elements being aligned with holes in the runner elements when the deck elements and runners are located in position.

21. A plastic pallet as claimed at claim 1, wherein the interengaging portions of the top deck elements with each of the end runners precluding movement of the end runners toward each other and precluding transverse and vertical relative movement between the end runners and the top deck elements.

22. A plastic pallet as claimed in claim 21, wherein the interengaging portions of the end runners and the bottom deck elements being such as to preclude movement of the end runners toward each other and to preclude relative movement in the transverse and vertical direction between the end runners and the bottom deck elements.

23. A plastic pallet as claimed in claim 22, wherein the interengaging portions of the top and bottom deck elements and the intermediate runner precludes transverse movement of the intermediate runner toward either of the end runners and longitudinal movement of the intermediate runner relative to the top and bottom deck elements.

24. A plastic pallet as claimed in claim 1, wherein the interengaging portions of the top and bottom deck elements and the intermediate runner precludes transverse movement of the intermediate runner toward either of the end runners and longitudinal movement of the intermediate runner relative to the top and bottom deck elements.

* * * * *